US005661912A

United States Patent [19]

Bhatnagar et al.

[11] Patent Number: 5,661,912

[45] Date of Patent: Sep. 2, 1997

[54] DRIER FOR A PAINTING PLANT

[75] Inventors: Satpal Bhatnagar, Vaihingen-Rosswag; Gunther Küchenthal, Ludwigsburg; Dietmar Wieland, Stuttgart, all of Germany

[73] Assignee: Dürr GmbH, Stuttgart, Germany

[21] Appl. No.: 540,236

[22] Filed: Oct. 6, 1995

[30] Foreign Application Priority Data

Oct. 8, 1994 [DE] Germany ..... 44 36 018.5

[51] Int. Cl.[6] ..... F26B 3/34

[52] U.S. Cl. ..... 34/270; 34/271; 34/666; 34/267

[58] Field of Search ..... 34/79, 219, 223, 34/266, 267, 270, 271, 666

[56] References Cited

U.S. PATENT DOCUMENTS

| | | | |
|---|---|---|---|
| 2,711,310 | 6/1955 | Morrill | 263/19 |
| 4,493,641 | 1/1985 | Hubbert | 432/120 |
| 4,546,553 | 10/1985 | Best | 34/39 |
| 4,635,381 | 1/1987 | Hubbert | 34/54 |
| 4,670,994 | 6/1987 | Takata et al. | 34/39 |
| 4,761,894 | 8/1988 | Hamasaki et al. | 34/39 |
| 4,785,552 | 11/1988 | Best | 34/30 |
| 4,907,533 | 3/1990 | Nelson et al. | 118/663 |
| 4,908,231 | 3/1990 | Nelson et al. | 427/55 |
| 4,967,487 | 11/1990 | Urguhart | 34/66 |
| 5,070,625 | 12/1991 | Urguhart | 34/39 |
| 5,456,023 | 10/1995 | Farnan | 34/270 |
| 5,568,692 | 10/1996 | Crompton et al. | 34/270 |

FOREIGN PATENT DOCUMENTS

| | | | |
|---|---|---|---|
| 0 420 554 | 4/1991 | European Pat. Off. . | |
| 4-358556 | 12/1992 | Japan | 34/666 |
| 591670 | 2/1978 | U.S.S.R. | 34/270 |
| WO81/00448 | 2/1981 | WIPO . | |

*Primary Examiner*—Henry A. Bennett
*Assistant Examiner*—Dinnatia Doster
*Attorney, Agent, or Firm*—Edward J. Timmer

[57] ABSTRACT

Booth-type drier for a painting plant, in particular, for vehicle bodies, comprising a booth interior for receiving painted articles to be dried and at least one heating element arranged in the drier for heating the articles, the heating element being, for its part, heatable using waste air from the painting plant which has undergone thermal cleaning and has thereby been heated up and which is conducted through at least one pure gas pipeline, wherein to minimize the investment and operating costs, the pure gas pipeline is laid in the drier and designed to give off heat to the booth interior.

20 Claims, 4 Drawing Sheets

DRIER FOR A PAINTING PLANT

Figure 1:
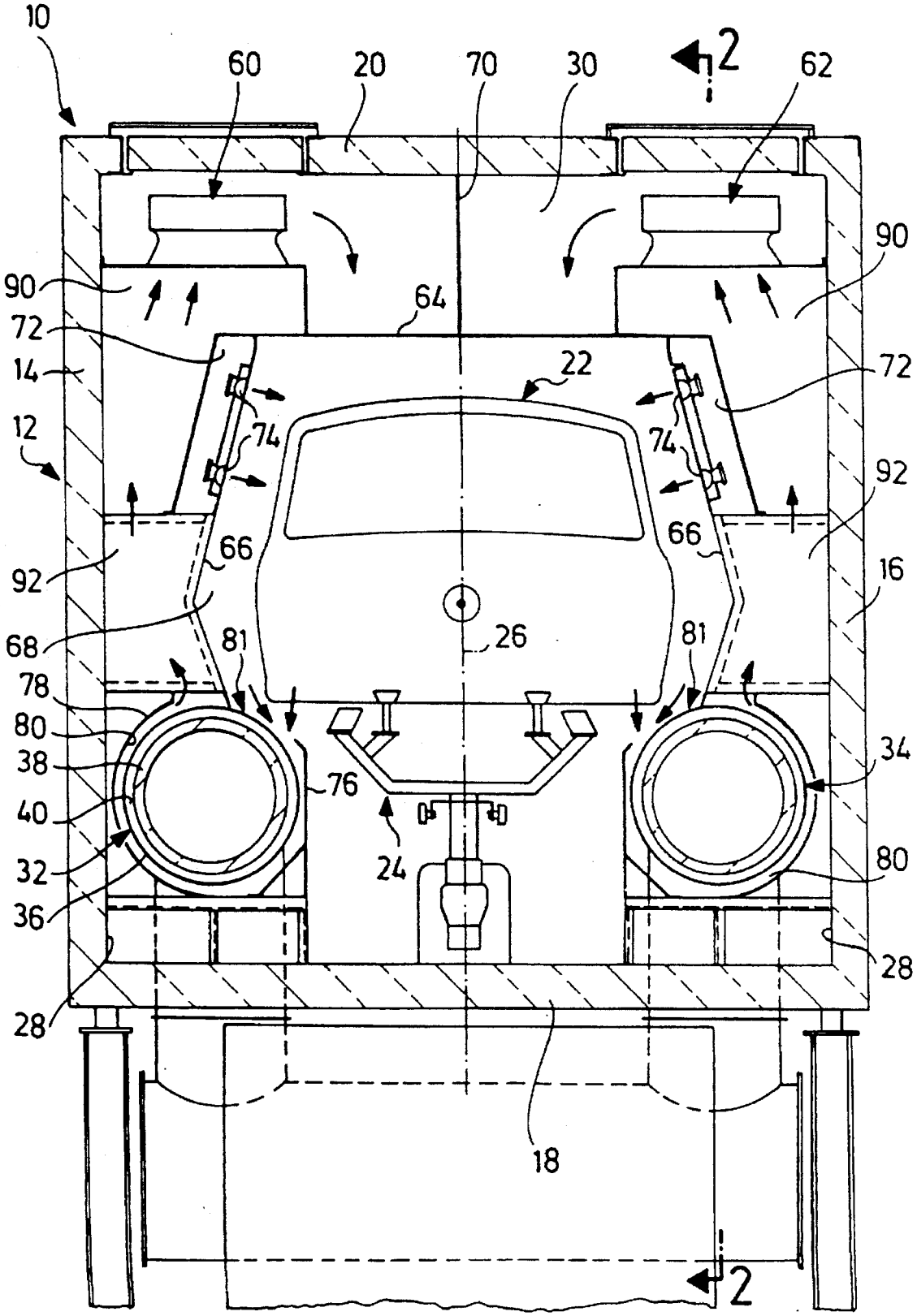

The invention relates to a booth-type drier for a painting plant constituting a booth interior for receiving one or several painted articles to be dried. In particular, the invention relates to a drier for drying painted vehicle bodies.

The waste air of a painting plant, whether it be the waste air of a paint spraying booth or, for example, the waste air of a drier, contains solvent vapors, and, consequently, cannot simply be discharged into the environment. It is, therefore, state of the art for the waste air charged with solvent vapors to undergo thermal cleaning during which the solvent component is oxidized and/or burned. During this exothermal reaction the waste air is heated to a relatively high degree, and a so-called pure gas with typical temperatures of 450° to 500° C. is obtained. This makes it possible for, for example, the drier of a painting plant to be heated with this hot pure gas as heat transfer medium. So far, this has been carried out in the following way: There is arranged above or below the drier a shell-and-tube heat exchanger through which, on the one hand, the hot pure gas and, on the other hand, drying air recirculated in the booth interior of the drier is conducted. Infrared radiators, so-called dark body radiators can be additionally or alternatively arranged in the booth interior. These are directed at the painted articles to be dried and are heated with the aid of a heat transfer gas which is conducted in a circuit and to which hot pure gas is added in a controlled manner.

The investment and operating costs involved in these known drier-heating systems are both relatively high: Not only are expensive shell-and-tube heat exchangers necessary, but these also require together with the pipeline for the hot pure gas used as heating gas and the necessary connection parts a structural height of the order of 3.5 to 4 meters. In addition, the flow resistances caused by the shell-and-tube heat exchangers and the connecting channels require a relatively high amount of power for operating the necessary ventilators.

The object underlying the invention is, therefore, to produce a drier which is more cost efficient. Departing from a booth-type drier of the kind mentioned at the beginning comprising a booth interior for receiving painted articles to be dried and at least one heating element arranged in the drier for heating the articles, the heating element being, for its part, heatable using a hot gas (heating gas) conducted through at least one heating gas pipeline, this object is accomplished in accordance with the invention in that the heating gas pipeline is laid in the drier and is designed to give off heat to the booth interior.

A drier according to the invention, therefore, requires no separate heat exchanger heating units, and so not only is assembly simplified for the operator, but also the space requirement is lower than when known driers are used. The operator's electric power consumption is also lower because the heating system of the drier according to the invention offers the gases to be conducted or recirculated a lower flow resistance. In addition, a drier according to the invention can be heated up much more quickly since the masses which have to be heated up are smaller owing to the differences to the prior art. The heating system of a drier according to the invention also has smaller hot surfaces outside the drier itself and so less heat is given off to the workshop area in which the drier is assembled than in the prior art.

As is evident from the above statements, it is, of course, possible to make use of the invention in a system in which instead of thermally cleaned or otherwise heated waste air from the painting plant, another heat transfer medium is used for heating the drier. However, the invention gains particular significance when waste air from the painting plant which has undergone thermal cleaning or has been heated in some other way is used.

As will be apparent from the following, the invention covers both embodiments in which the actual heating gas pipeline is used for giving off heat directly and embodiments in which the heat is given off indirectly, i.e., through a further heat transfer medium.

In a preferred embodiment of the drier according to the invention, at least one surface area of the heating gas pipeline facing the articles to be dried is designed as an infrared radiator in order to heat up the painted article to be dried quickly by means of intensive heat radiation.

When several heating gas pipelines are laid in the drier, drying can be carried out solely by means of heat radiation. However, embodiments are preferred wherein the drier is provided with a recirculating air system comprising at least one ventilator for recirculating the circulating air, first air conducting means for forcing the recirculating air to flow at least partially around the heating gas pipeline, and second air conducting means for acting upon the articles to be dried with heated recirculating air. In such a drier, the painted articles to be dried can be dried solely by means of heated-up recirculating air. However, a combination of drying with heated recirculating air and drying by heat radiation is preferred because articles such as vehicle bodies can then be heated up uniformly with particular rapidity. In embodiments with such combined drying the advantages of the invention become particularly evident because no measures involving an increase in costs are necessary to implement drying by heat radiation in addition to the drying with heated recirculating air. A particularly simple construction of the drier according to the invention is achieved for such a case by the first air conducting means enclosing the heating gas pipeline only partially, i.e., with the exception of its surface area acting as infrared radiator.

It is specifically when a certain area or several certain areas of the articles to be dried is or are to be dried essentially by heat radiation that it is advantageous for the second air conducting means to comprise nozzles directed at the articles to be dried so that the heated recirculating air can be targeted at those areas which are not subjected to infrared radiation.

In order that a painted article to be dried will be dried uniformly all around it, in preferred embodiments of the drier according to the invention, several and, in particular, two heating gas pipelines are laid in the drier symmetrically in relation to the articles to be dried so that the article to be dried can be acted upon with heated recirculating air or by heat radiation symmetrically. This may require several ventilators for conveying the recirculating air.

Obviously, the one heating gas pipeline or several heating gas pipelines could, in principle, be laid at any chosen location and so as to run in any chosen direction in the drier. Above all, in a drier through which the articles to be dried are moved in a longitudinal direction of the drier, it is, however, more advantageous for the heating gas pipeline to extend in the longitudinal direction of the booth interior.

Painted articles or articles to be painted often have areas which are more difficult to heat up than others. In vehicle bodies this applies particularly to the so-called body sills. In such a case, provision is made by the invention for the heating gas pipeline to be arranged adjacent to the area which is harder to heat up, and, in particular, for the purpose of subjecting this area which is harder to heat up to heat radiation, for a surface area of the heating gas pipeline facing this area to be designed as an infrared radiator. However, since recirculating air is hottest in the immediate vicinity of the heating gas pipeline acting as heating element, arrangement of the heating gas pipeline in the vicinity of the area which is harder to heat up is also recommended when it is not dried with the aid of heat radiation.

Because of the considerable weight of the heating gas pipeline and also of the fact that air heated by the heating gas pipeline attempts to rise owing to its lower specific weight and painted vehicle bodies are generally introduced into a drier in such a way that the underside of the body with its areas which are harder to heat up is at the bottom, it is recommended that the heating gas pipeline be arranged in the region of the floor of the booth interior and, when there are two heating gas pipelines, that these be laid along the lower corner regions of the booth interior.

In order not to have to mix hot pure gas produced by the thermal waste air cleaning or another heating gas with a further gas so as to enable control and regulation of the temperatures in the drier and the emission of heat to the articles to be dried, provision is made in accordance with the invention in a particularly advantageous embodiment of the drier for the construction to be such that the heating gas pipeline comprises an outer wall and within this outer wall over at least part of the longitudinal section of the heating gas pipeline extending in the drier two heating gas channels extending parallel to each other and separated from each other by an inner wall of the heating gas pipeline having heat-insulating properties, a first heating gas channel thereof being delimited by the outer wall over at least part of its circumference, and such that a valve-type control device for controllable alteration of the flow cross section of at least the first heating gas channel is provided in the region of the inflow end of the first heating gas channel. In this way, the inflow end of the first heating gas channel is either fully closeable or fully or partly openable so that area of the outer wall on which the first heating gas channel abuts and which serves to emit the heat to the articles to be dried either remains cold or is heated up in a controllable manner to the maximum temperature attainable. Embodiments are particularly preferred in which the control device is designed for controllable alteration of the flow cross sections of both heating gas channels so that the second heating gas channel can be made to have no heating gas at all flowing through it, which offers special advantages when the construction is such that the second heating gas channel does not contribute towards emitting heat to the articles to be dried.

Such a construction is made particularly simple by the inner wall enclosing an inner pipe and—in cross section through the heating gas pipeline—forming an annular gap located between the outer wall and the inner wall. The valve-type control device can then have, for example, an annular flap rotatable through one pipe diameter for closing and opening this annular gap and a circular disk-shaped flap likewise rotatable through one diameter for closing the inner pipe. The flap design does, however, of course, depend on the design of the inflow ends of the inner pipe and the area between the inner pipe and the outer wall. The construction of such a control device is simplest when it has two flaps attached to a common shaft, with one of these flaps being associated with the first heating gas channel and the other flap with the second heating gas channel, and the flaps being attached to the shaft in offset relation to each other through 90° in the direction of rotation of the shaft so that by rotating the shaft through 90°, the one heating gas channel is fully openable and the other heating gas channel is fully closeable, but any other distribution of the heating gas to the two heating gas channels is also possible. In this connection, it must be borne in mind that the greater the emission of heat to the articles to be dried is to be, the less hot heating gas will be allowed to flow through the second heating gas channel.

In order to provide a heating zone in the drier which is limited length-wise, it is recommended that the drier according to the invention be constructed such that the aforementioned inner wall of the heating gas pipeline be shorter—in the longitudinal direction of the heating gas pipeline—than the outer wall and that it terminate before the respective end of the booth interior.

This last aforementioned embodiment proves particularly advantageous in cases where in accordance with the invention the drier forms a module, a drier installation of the painting plant can be built up of several such identical modules arranged one behind the other, and the heating gas pipeline extends through the entire drier installation. With one valve-type control device per module, the heat emission can then be individually controlled for each of the modules.

Figure 2:
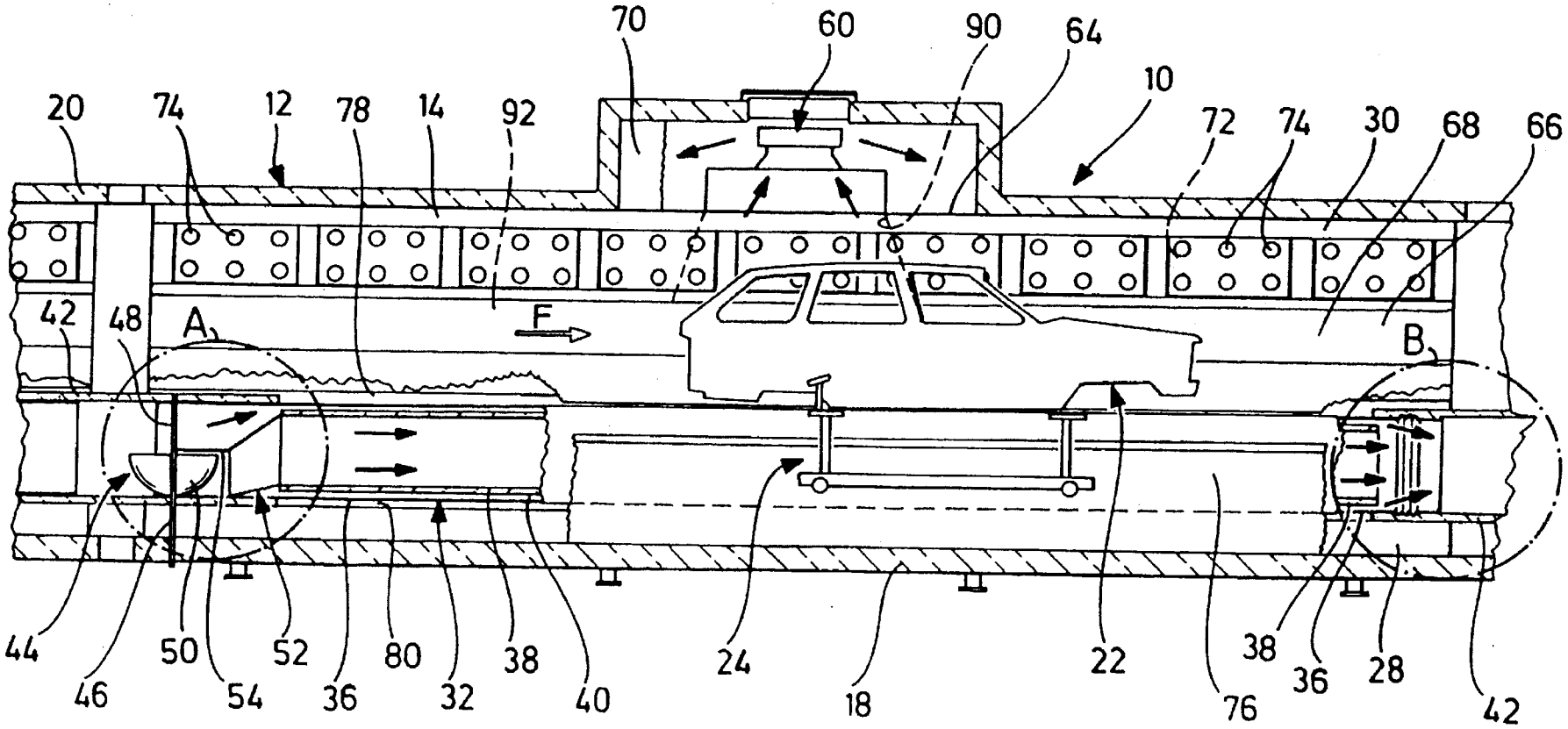
Figure 3:
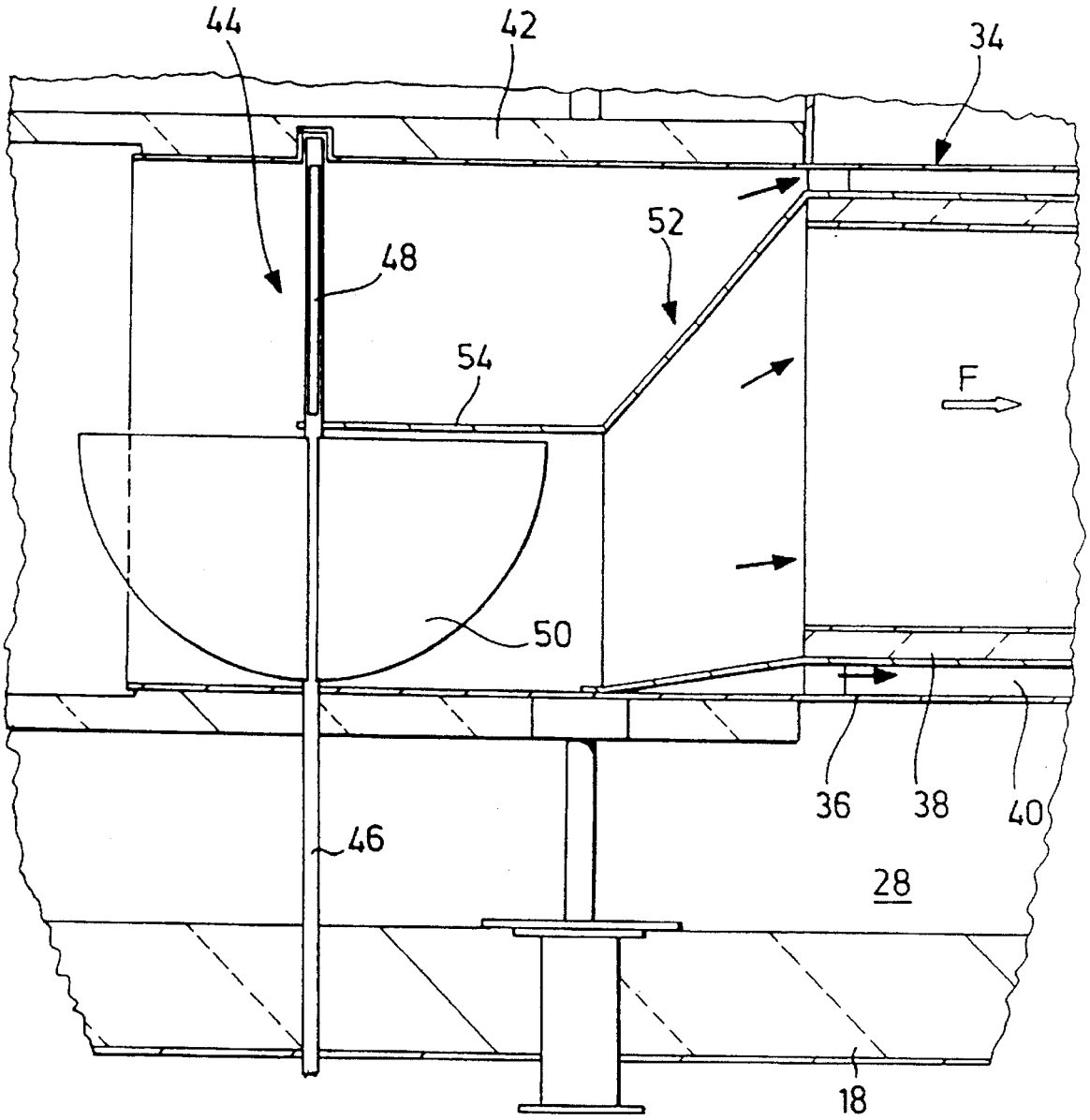

Further features, advantages and details of the invention are apparent from the attached claims and/or the following description and the attached drawings of a particularly advantageous embodiment of the drier according to the invention. The drawings show:

FIG. 1 a cross section through the drier, more particularly, perpendicular to that direction in which the painted articles to be dried—in this case vehicle bodies—are moved through the drier;

FIG. 2 a longitudinal section through the drier taken along a vertical plane, more particularly, according to line 2—2 in FIG. 1;

FIG. 3 the detail designated "A" in FIG. 2 on a larger scale; and

Figure 4:
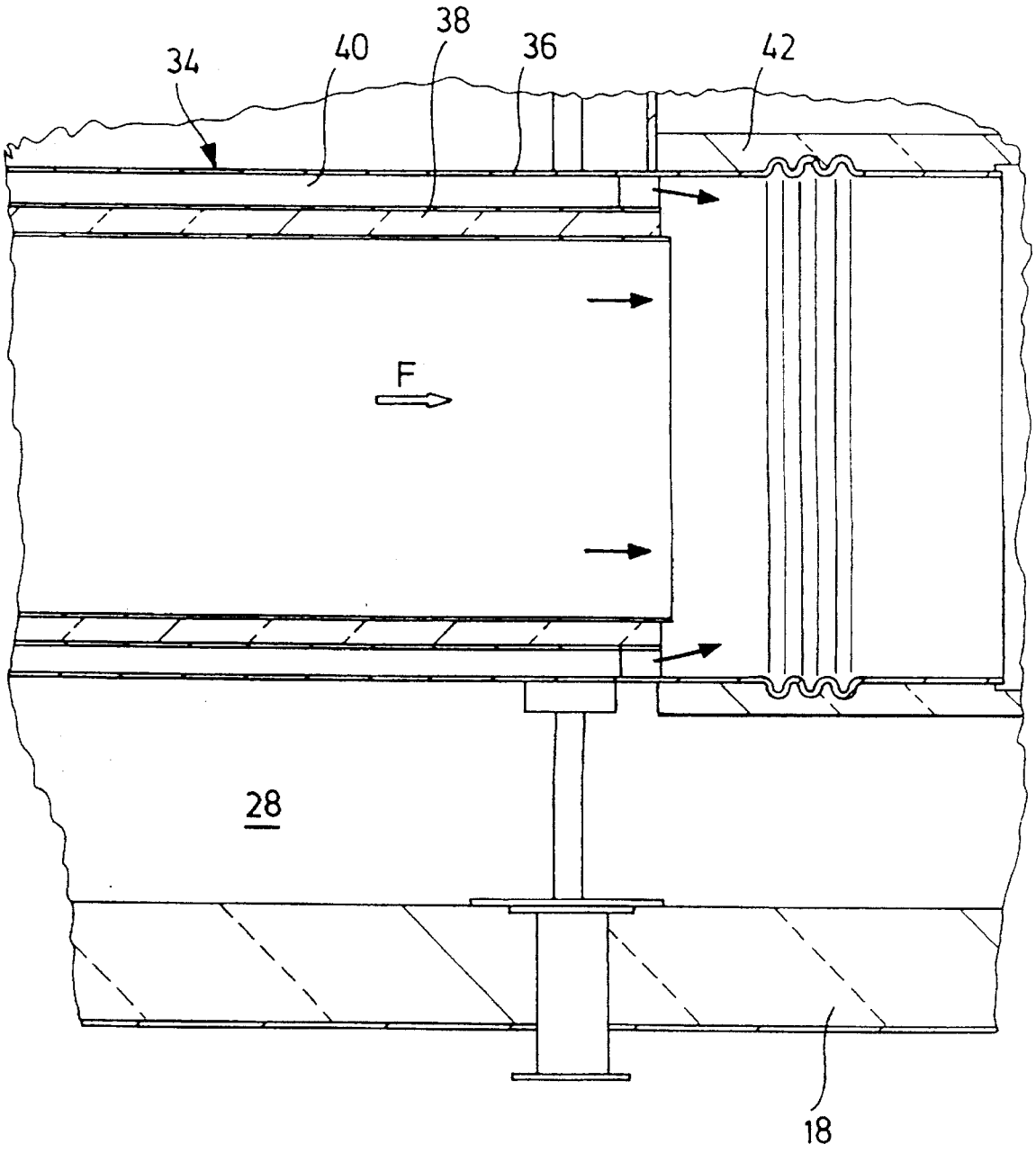

FIG. 4 the detail designated "B" in FIG. 2 on a larger scale.

The embodiment described hereinbelow is to be operated with waste air from the painting plant which has been heated in the course of thermal cleaning (so-called pure gas) as heating medium, and, therefore, the term "pure gas pipeline", for example, is used throughout the following. The construction illustrated and described herein is, however, also suitable for operation with any other hot gas as heating gas, and, in this case, the said pipeline would then be referred to generally as heating gas pipeline. It is also quite conceivable for the waste air from the painting plant which is heatable by thermal cleaning to not undergo thermal cleaning until it is inside the heating gas pipeline and to then be heated.

FIG. 1 shows a drier designated in its entirety 10 with a drier booth 12 formed by heat-insulating walls. The side walls thereof are designated 14 and 16, the floor 18 and the ceiling 20. As in FIG. 2, a painted vehicle body 22 which is to be dried is indicated in FIG. 1. It rests on a so-called body slide 24 (also called skid) and is moveable together with the skid by known conveyor means perpendicularly to the drawing plane of FIG. 1, e.g., in the direction of arrow "F" in FIG. 2 slowly through the drier.

As FIG. 1 shows, the drier 10 is designed in accordance with the invention symmetrically in relation to a vertical longitudinal center plane 26. Immediately above two fresh air channels 28 extending in the longitudinal direction of booth 12 and arranged in the two lower corners of a booth interior 30 are two pure gas pipelines designated in their entirety 32 and 34, respectively. These likewise extend in the longitudinal direction of the booth and are carried by supports, not shown in the drawings for reasons of simplicity, which are supported on the fresh air channels 28. Each of the two pure gas pipelines 32, 34 has a good heat-conducting and, in particular, metallic outer pipe 36 and an inner pipe 38 concentric with the outer pipe and provided with a heat-insulating layer, with an annular gap 40 located between the inner pipe 38 and the outer pipe 36. As shown in FIG. 2, but more clearly in FIGS. 3 and 4, the outer pipe 36 extends over the entire length of the drier booth 12, while the inner pipe 38 terminates at a distance from the end walls of booth 12.

In accordance with the invention, a drier installation of a painting plant is to be comprised of several driers 10 arranged one behind the other, as indicated in FIGS. 2 through 4. Such a drier installation, therefore, has two pure gas pipelines 32 and 34 extending through the entire installation, and the way in which the heating zones formed by these two pure gas pipelines for each of these driers can be individually controlled will be explained hereinbelow with reference to FIG. 3.

In the following it is to be borne in mind that the hot pure gas according to FIGS. 2 through 4 flows through the pure gas pipelines from the left to the right, as indicated by arrows in FIG. 2. It is also to be noted that those sections of the outer pipe 36 located at the transitions between two driers arranged one behind the other and extending from the outlet end of the inner pipe 38 of the one drier to the inlet end of the inner pipe 38 of the following drier are provided with an insulating jacket 42 for thermal insulation.

FIG. 3 shows a valve-type control device designated in its entirety 44 for individual setting of the heating capacity of the following heating zone, i.e., the heating capacity of that section of the heating gas pipeline 32, 34 which is located in the respective drier 10. This control device 44 has a shaft 46 which in the illustrated embodiment is vertically orientated. This shaft 46 is rotatably mounted in the outer pipe 36 and protrudes downwardly from it so that a drive formed, for example, by a geared motor, but not illustrated, can engage there. Two flaps of identical design, i.e., an upper flap 48 and a lower flap 50 which are offset in relation to each other through a rotational angle of 90°, but each have the shape of a semicircular disk, are attached to the shaft 46. FIG. 3 shows the lower flap 50 in a position in which it extends parallel to the drawing plane of FIG. 3, while the upper flap 48 is orientated vertically to this drawing plane.

Immediately adjoining the left end of the inner pipe 38, according to FIG. 3, is a kind of funnel 52 whose right end forms a circular opening adapted to the inner pipe 38 and whose left end forms an opening whose shape corresponds to that of the lower flap 50, i.e., a semicircular disk. Adjoining the left end of the funnel 52 is, on the one hand, the lower half of the outer pipe 36 and, on the other hand, a horizontal dividing wall 54 which extends from the funnel 52 to the shaft 46 and in its region divides the interior of the outer pipe 36 into two equal halves, i.e., into a lower half which is closeable by the lower flap 50 and an upper half which in the position of the control device 44 illustrated in FIG. 3 is closed by the upper flap 48. If the shaft 46 is turned through 90°, the upper flap 48 opens the flow cross section of the outer pipe 36 above the dividing wall 54, while the lower flap 50 closes the flow cross section of the outer pipe 36 below the dividing wall. The control device 44, therefore, makes it possible either for the entire incoming hot pure gas to be introduced into the inner pipe 38 and for this heating zone to thus be switched off or for the entire incoming hot pure gas to be introduced into the annular gap 40 so that this heating zone then gives off its maximum heating power. The control device 44 also makes it possible for any state between these two aforementioned extreme states to be set.

A recirculating air system of the drier according to the invention is best explained with reference to FIG. 1. It comprises two ventilators 60 and 62 which circulate the air in the booth interior 30 in the way indicated by arrows in FIG. 1. The intake side of the two ventilators is located on their lower side, and the air conveyed by the two ventilators is urged into that part of the booth interior 30 which is located below the booth ceiling 20 between the two ventilators. Walls 64 and 66 form in the booth interior 30 a work area of the drier in the form of a longitudinal channel 68 through which the vehicle bodies 22 are moved. In the illustrated embodiment, there is also a separating wall 70 which extends in the longitudinal center plane 26 between the ceiling 20 of the booth 12 and the wall 64 of the longitudinal channel 68, but is not necessary from a functional point of view and could also be replaced by a fresh air channel which would act as a substitute for the fresh air channels 28.

On the outside of each of the two walls 66 is a supply channel 72 which is supplied in a manner explained hereinbelow with air conveyed by the ventilators 60 and 62 which then flows out through nozzles 74 directed at the vehicle body 22 into the longitudinal channel 68. This recirculated air is then made to flow around the respective pure gas pipeline 32, 34 by an air conducting system which is formed by sheet metal walls 76 and 78 and one of the respective walls 66, thereby producing in cross section an annular gap 80 which encloses the respective pure gas pipeline 32, 34 to a major extent. Towards the longitudinal channel 68, however, that sector 81 of the respective pure gas pipeline 32, 34 which is located between the lower edge of the adjacent wall 66 and the upper edge of the adjacent wall 76 remains exposed so that this sector 81 of the pure gas pipeline can function as an infrared or dark body radiator which is directed at the sill areas of the vehicle body 22.

The recirculating air urged through the respective annular gap 80 then leaves this annular gap between the upper end of the wall 78 and the wall 66 and is aspirated by the respective ventilator 60, 62 located on this side of the booth, i.e., conveyed from the bottom upwards. As indicated in FIG. 2, each of the ventilators 60, 62 is arranged on a shaft 90 which separates the intake side of the respective ventilator from its pressure side and via which the air to be recirculated is aspirated from below. In front of and behind the shafts 90, the supply channels 72 have a larger cross section than that shown in FIG. 1 and extend, on the one hand,—together with the walls 66—as far as the ceiling 20 and, on the other hand, as far as the respective adjacent side wall 14, 16. On the inner sides of the side walls 14 and 16 of the booth 12 are chambers 92 which extend in the longitudinal direction of the booth, which the air aspirated from the annular gaps 80 enters from below and out of which the ventilators 60, 62 aspirate the air via the shafts 90. The supply channels 72 communicate in a manner not shown in greater detail with the pressure spaces of the two ventilators located between the ventilators and the dividing wall 70. In this way the air circuit is closed for each of the ventilators 60 and 62.

What is claimed is:

1. Booth-type drier for a painting plant comprising:

a booth interior for receiving painted articles to be dried;

at least one heating element arranged in said drier and having a first side in communication with said booth interior for giving off heat to said booth interior in order to heat said articles, and a second side opposite to said first side;

at least one heating gas pipeline arranged within the drier for flowing a hot heating gas therethrough;

a heating gas duct for flowing hot heating gas therethrough, said duct having an inner wall surface at least part of which is formed by the second side of said heating element in order to expose said second side to hot heating gas for heating said heating element, said duct having an inflow end and an outflow end and being connected in parallel with said pipeline;

and a valve-type control device associated with said duct for controlling the temperature of said heating element by controlling flow rate of heating gas through said duct.

2. Drier as claimed in claim 1, wherein at least part of said first side of said heating element is designed as an infrared radiator and arranged to face said booth interior and therefore an article to be dried.

3. Drier as claimed in claim 1, said drier being provided with an air circulating system comprising at least one blower, said system comprising first air conducting means for forcing circulating air to flow over at least part of said first side of said heating element so that the circulating air is heated, and second air conducting means for directing heated circulating air at an article to be dried within said booth interior.

4. Drier as claimed in claim 1, wherein said heating element is in the form of a first pipe enclosing said duct.

5. Drier as claimed in claim 1, said drier being provided with an air circulating system comprising at least one blower, said system comprising first air conducting means for forcing circulating air to flow over at least part of said first side of said heating element so that the circulating air is heated, and second air conducting means for directing heated circulating air at an article to be dried within said booth interior, said heating element being in the form of a first pipe enclosing said duct, wherein said first air conducting means encloses said first pipe circumferentially with the exception of a sector of said first side forming said infrared radiator.

6. Drier as claimed in claim 3, wherein said second air conducting means is provided with air nozzles directed at an article to be dried within said booth interior.

7. Drier as claimed in claim 1, said drier having:

a channel with an inlet end and an outlet end for moving articles to be dried through the drier along a path extending along said channel, a first heating gas pipeline and a second heating gas pipeline extending in the longitudinal direction of said channel between said inlet and said outlet end, a first heating gas duct associated with said first pipeline and a second heating gas duct associated with said second pipeline and extending parallel thereto, and a first valve-type control device associated with said first duct and a second valve-type control device associated with said second duct, said first pipeline and said first duct and said second pipeline and said second duct being arranged symmetrically in relation to a plane through said path.

8. Drier as claimed in claim 7 for drying painted vehicle bodies having two body sills, wherein said ducts are disposed adjacent said sills.

9. Drier as claimed in claim 8, wherein said first heating gas duct provides for a first heating element designed as a first infrared radiator and said second heating gas duct provides for a second heating element also designed as an infrared radiator, and wherein said first infrared radiator is arranged to face a first one of said body sills and said second infrared radiator is arranged to face a second one of said body sills.

10. Drier as claimed in claim 7, wherein said plane is vertical plane and said pipelines are arranged adjacent a lower portion of said channel.

11. Drier as claimed in claim 10, wherein said pipelines are arranged in lower corner regions of said booth interior.

12. Drier as claimed in claim 1, said drier being provided with at least one heating gas conduit comprising an outer wall and within said outer wall over at least part of a longitudinal section of said circuit disposed within the drier a first heating gas channel and a second heating gas channel extending parallel to each other and separated from each other by an inner wall, said first heating gas channel being delimited over at least part of its circumference by said outer wall, said first heating gas channel forming said duct and said second heating gas channel forming said heating gas pipeline, said valve-type control device being disposed in a region of the inflow end of said first heating gas channel.

13. Drier as claimed in claim 12, wherein said inner wall is a heat-insulating wall.

14. Drier as claimed in claim 12, wherein said control device is designed for correlated controlling of the gas flow rates through said first and said second heating gas channels.

15. Drier as claimed in claim 14, wherein said control device has two flaps attached to a common shaft, one of said flaps being associated with said first heating gas channel and said other flap with said second heating gas channel, said flaps being attached to said shaft in offset relation to each other through 90° in the direction of rotation of said shaft so that by rotating said shaft through 90°, one of the respective heating gas channels is fully openable and the other respective heating gas channel is fully closable.

16. Drier as claimed in claim 12, wherein said outer wall forms an outer pipe and said inner wall forms an inner pipe with an annular gap forming said duct being provided between said outer and inner pipes.

17. Drier as claimed in claim 12, wherein, in the longitudinal direction of said heating gas conduit, said inner wall is shorter than said outer wall and terminates before ends of said booth interior preceding and following, respectively, said inner wall.

18. Drier as claimed in claim 1, said drier constituting a module adapted for putting together a drier installation of said painting plant out of several such identical modules arranged one behind the other, and wherein said heating gas pipeline extends through all of said modules.

19. Drier as claimed in claim 18, wherein said heating gas pipeline is feedable with heated waste air from said painting plant.

20. Drier as claimed in claim 19, wherein said heating gas pipeline is feedable with thermally cleaned waste air from said painting plant.

* * * * *